US010811812B2

(12) United States Patent
Miyazawa

(10) Patent No.: US 10,811,812 B2
(45) Date of Patent: Oct. 20, 2020

(54) WATERPROOF CONNECTOR INCLUDING REAR HOLDER FOR HOLDING WIRES AND PREVENTING WATERPROOF MEMBER FROM DETACHING FROM HOUSING

(71) Applicant: Yazaki Corporation, Minato-ku, Tokyo (JP)

(72) Inventor: Yuki Miyazawa, Kakegawa (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 16/592,066

(22) Filed: Oct. 3, 2019

(65) Prior Publication Data

US 2020/0119486 A1 Apr. 16, 2020

(30) Foreign Application Priority Data

Oct. 10, 2018 (JP) ..... 2018-191909

(51) Int. Cl.
*H01R 13/40* (2006.01)
*H01R 13/52* (2006.01)
*H01R 13/506* (2006.01)
*H01R 13/436* (2006.01)

(52) U.S. Cl.
CPC ..... *H01R 13/5205* (2013.01); *H01R 13/4367* (2013.01); *H01R 13/506* (2013.01)

(58) Field of Classification Search
CPC ..... H01R 13/5221; H01R 13/5208; H01R 13/5219; H01R 13/5205
USPC ..... 439/274, 275, 278, 279, 587, 589
See application file for complete search history.

(56) References Cited

U.S. PATENT DOCUMENTS 5,573,429 A * 11/1996 Miyazaki ..... H01R 13/5205 439/587
5,634,807 A * 6/1997 Saito ..... H01R 13/5208 439/275
5,645,451 A * 7/1997 Ohsumi ..... H01R 13/5208 277/637
5,709,563 A * 1/1998 Saito ..... H01R 13/5208 439/275
5,890,927 A * 4/1999 Yashima ..... H01R 13/5208 439/587
6,331,124 B1 * 12/2001 Miyazaki ..... H01R 13/5208 439/587

(Continued)

FOREIGN PATENT DOCUMENTS

JP 2013-239364 A 11/2013

*Primary Examiner* — Thanh Tam T Le
(74) *Attorney, Agent, or Firm* — Banner & Witcoff, Ltd.

(57) ABSTRACT

A waterproof connector includes a housing in which a plurality of terminal accommodation chambers that accommodate terminals connected to electric wires are arranged in a plurality of rows, at least one waterproof member of a plurality of waterproof members provided between the housing and one of the electric wires so as to divide the inside of the housing from the outside of the housing, and a rear holder assembled to the housing so as to prevent detachment of the at least one waterproof member from the housing. The rear holder includes two combining members with mating surfaces that are combined with each other so as to hold the electric wires, and that form an electric wire accommodation portion accommodating the electric wires when the mating surfaces are mated.

5 Claims, 11 Drawing Sheets

(56) References Cited

U.S. PATENT DOCUMENTS

| | | | | |
|---|---|---|---|---|
| 6,398,585 | B1 * | 6/2002 | Fukuda | H01R 13/5208 439/587 |
| 7,033,216 | B2 * | 4/2006 | Ito | H01R 13/5208 439/275 |
| 7,044,762 | B1 * | 5/2006 | Hong | H01R 13/5213 439/275 |
| 7,101,217 | B2 * | 9/2006 | Hayashi | H01R 13/6592 439/447 |
| 7,762,842 | B2 * | 7/2010 | Deubel | H01R 13/5208 439/589 |
| 8,491,335 | B2 * | 7/2013 | Matsumoto | H01R 13/506 439/587 |
| 8,545,264 | B2 * | 10/2013 | Nawa | H01R 13/5208 439/274 |
| 9,293,878 | B2 * | 3/2016 | Tashiro | H01R 13/506 439/587 |
| 10,454,204 | B2 * | 10/2019 | Hara | H01R 13/5208 439/587 |
| 10,468,811 | B2 * | 11/2019 | Endo | H01R 13/6581 439/587 |
| 2015/0050826 | A1 | 2/2015 | Tashiro et al. | |

* cited by examiner

WATERPROOF CONNECTOR INCLUDING REAR HOLDER FOR HOLDING WIRES AND PREVENTING WATERPROOF MEMBER FROM DETACHING FROM HOUSING

CROSS REFERENCE TO RELATED APPLICATIONS

This application claims priority from Japanese Patent Application No. 2018-191909 filed on Oct. 10, 2018, the entire contents of which are incorporated herein by reference.

BACKGROUND OF THE INVENTION

Field of the Invention

The present invention relates to a waterproof connector.

Description of Related Art

In a related art, a waterproof connector has been known to include a housing that accommodates terminals connected to electric wires, waterproof members provided between the housing and the electric wires to divide inside of the housing from outside, and a rear holder that is assembled to the housing to prevent detachment of the waterproof members from the housing (for instance, see Patent Literature 1: JP-A-2013-239364).

In such a waterproof connector, the rear holder includes two combining members with mating surfaces that are combined by mating with each other to hold the electric wires, and that form electric wire accommodation portions to accommodate the electric wires when the mating surfaces are mated. Semicircular recesses are formed in the combining members, and cylindrical electric wire accommodation portions are formed by combining the two combining members.

Therefore, when the waterproof connector is assembled, the electric wires are not required to pass through a plurality of through holes of the rear holder first and the rear holder can be fitted later, thereby improving the workability.

[Patent Literature 1] JP-A-2013-239364

According to a related art, when a plurality of electric wires passing through a rear holder are arranged in a plurality of rows and stages by arranging a plurality of terminal accommodation chambers of a housing in a plurality of rows, a recesses forming an electric wire accommodation portions should not be semicircular, but be formed in a substantially oval shape that has an opening width equal to an electric wire diameter and is greatly recessed from a mating surface. Therefore, openings having an opening width equal to the electric wire diameter are generated between the electric wire accommodation portions and the electric wires. Therefore, an external force such as high-pressure washing water may reach the waterproof members through the openings to reduce the waterproofness of the waterproof members. Therefore, in the waterproof connector according to the related art, when the plurality of terminal accommodation chambers of the housing are arranged in the plurality of rows, the electric wires only pass through the plurality of through holes formed in the rear holder first, so that the workability of assembling the rear holder is low.

SUMMARY

One or more embodiments provide a waterproof connector in which a plurality of terminal accommodation chambers of a housing are arranged in a plurality of rows, and the workability of assembling the rear holder can be improved without reducing the waterproofness.

In an aspect (1), one or more embodiments provide a waterproof connector including a housing in which a plurality of terminal accommodation chambers that accommodate terminals connected to electric wires are arranged in a plurality of rows, at least one waterproof member of a plurality of waterproof members provided between the housing and one of the electric wires so as to divide the inside of the housing from the outside of the housing, and a rear holder assembled to the housing so as to prevent detachment of the at least one waterproof member from the housing. The rear holder includes two combining members with mating surfaces that are combined with each other so as to hold the electric wires, and that form an electric wire accommodation portion accommodating the electric wires when the mating surfaces are mated. The two combining members have slits that allow the electric wires to enter from mating surface sides and hold the electric wires. Opening widths of introduction portions of the slits extending to deepest portions of the slits are formed to be smaller than opening widths of the deepest portions. The two combining members have deflection slits extending from the mating surfaces on lateral sides of the introduction portions.

According to the aspect (1), the deepest portions of the slits in the electric wire accommodation portion formed in each of the two combining members are formed to have an opening width equal to or slightly smaller than an electric wire diameter in order to hold the inserted electric wires. The introduction portions of the slits are formed to have an opening width smaller than the opening width of the deepest portions. Here, since the introduction portions of the slits can be elastically deformed and widened due to the deflection slits formed laterally, the opening width can be set to be smaller than the electric wire diameter.

Therefore, the electric wires enter the slits of the electric wire accommodation portion formed in each of two combining members from the mating surface sides, and are moved to the deepest portion while pushing and spreading the introduction portions, whereby the electric wires come into in a state of penetrating the electric wire accommodation portion in the two combining members. Further, the rear holder, in which the combining members are combined by mating the mating surfaces, is assembled to the housing, so that detachment of the waterproof member can be prevented. At this time, at least an opening of the rear holder facing the waterproof member are only the slits having the opening width smaller than the electric wire diameter, and no opening having an opening width equal to the electric wire diameter is generated. Therefore, the rear holder can reduce the influence of an external force such as high-pressure washing water on the waterproof member.

Therefore, in the waterproof connector of the present configuration, even when a plurality of electric wires passing through the rear holder are arranged in a plurality of rows, the rear holder can be constituted by the two combining members without reducing the waterproofness, so that the workability of assembling the rear holder can be improved.

In an aspect (2), guiding tapers are formed at opening ends of the introduction portions.

According to the aspect (2), when the electric wire is inserted into the introduction portion of the slit from the mating surface side, the electric wire can easily enter the slit while pushing and spreading the introduction portion since the guiding taper is formed at the opening end.

Since the opening defined by the guiding taper is not arranged at a position facing the waterproof member, the external force such as high-pressure washing water does not reach the waterproof member through the opening.

In an aspect (3), the two combining members are provided with engagement portions that are engaged in a symmetrical shape when the mating surfaces are mated so as to maintain a combined state.

According to the aspect (3), the combining members are provided with engagement portions that are engaged in a symmetrical shape when the mating surfaces are mated so as to maintain a combined state. Therefore, even in a case where the two combining members have the same shape, the engagement portions can maintain the combined state. Therefore, in the waterproof connector having the present configuration, the rear holder can be formed of one kind of the combining members, so that the number of parts and the manufacturing cost can be reduced.

In the aspect (4), the two combining members are provided with mating portions at both ends of the mating surfaces, the mating portions engaged with recesses of the housing to maintain the combined state.

According to the aspect (4), in the two combining members constituting the rear holder, the mating portions at both ends of the mating surfaces are engaged with the recesses of the housing to maintain the combined state. Therefore, a gap is prevented from being generated between the mating surfaces of the two combining members, and the two combining members can be firmly coupled.

According to one or more embodiments, in the waterproof connector in which the plurality of terminal accommodating chambers of the housing are arranged in the plurality of rows, the workability of assembling the rear holder can be improved without reducing the waterproofness.

The present invention has been briefly described as above. Details of the present invention will be further clarified by reading a mode for carrying out the present invention described below with reference to the accompanying drawings.

DETAILED DESCRIPTION

Hereinafter, exemplary embodiments will be described with reference to the drawings.

Figure 1:
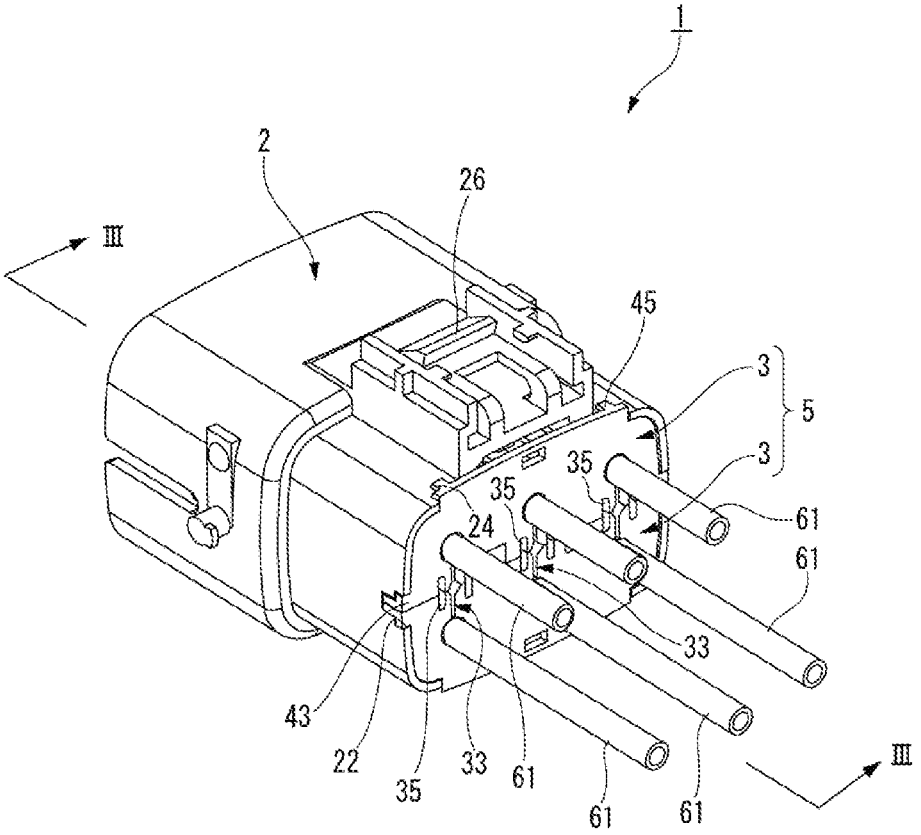
FIG. 1 is a perspective view of a waterproof connector according to an embodiment.
Figure 2:
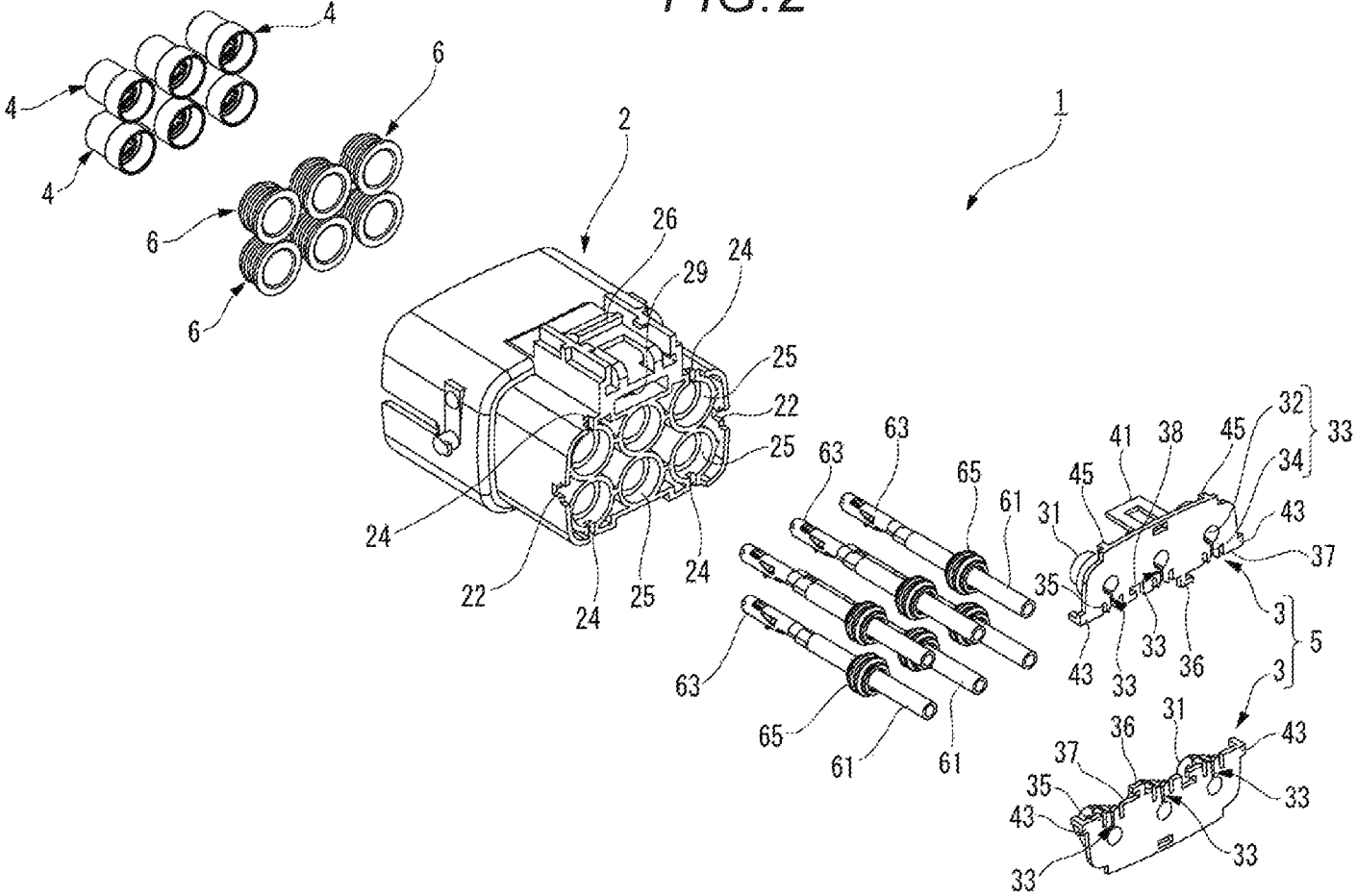
FIG. 2 is an exploded perspective view of the waterproof connector shown in FIG. 1.
Figure 3:
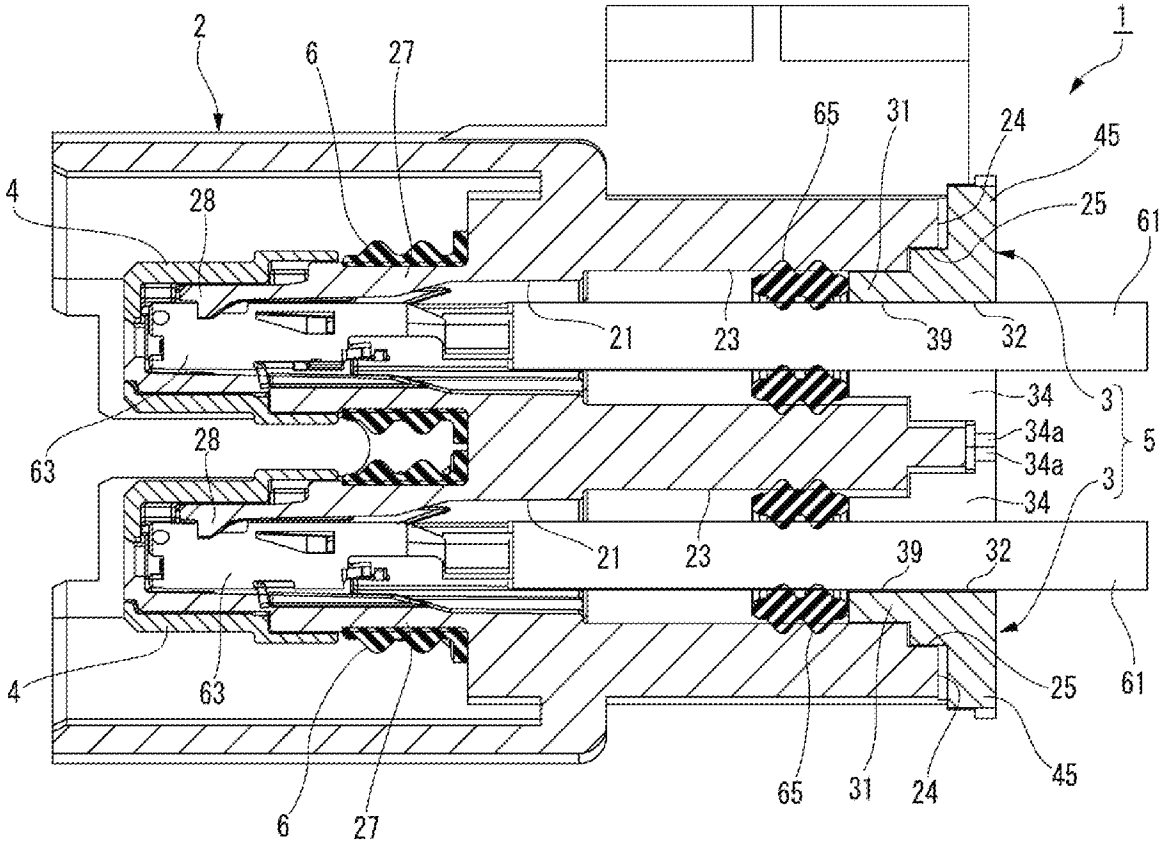
FIG. 3 is a cross-sectional view taken along line of the waterproof connector shown in FIG. 1.

FIG. 1 is a perspective view of a waterproof connector 1 according to an embodiment of the present invention. FIG. 2 is an exploded perspective view of the waterproof connector 1 shown in FIG. 1. FIG. 3 is a cross-sectional view taken along line of the waterproof connector 1 shown in FIG. 1.

As shown in FIGS. 1 to 3, the waterproof connector 1 according to the present embodiment includes a housing 2 where a plurality of terminal accommodation chambers 21 that accommodate terminals 63 connected to electric wires 61 are arranged in a plurality of rows, waterproof members 65 provided between the housing 2 and the electric wires 61 to divide inside of the housing 2 from outside, and a rear holder 5 assembled to the housing 2 to prevent detachment of the waterproof members 65 from the housing 2.

The housing 2 is molded from an electrically insulating synthetic resin, and the plurality of (six in the present embodiment) terminal accommodation chambers 21 are arranged in upper and lower two rows, each row horizontally having three terminal accommodating chambers. The housing 2 is formed so as to include rear holder accommodation spaces 25 on a rear side where the electric wires 61 with the terminals 63 crimped to ends thereof are inserted, waterproof member accommodation spaces 23 adjacent to a deep side of the rear holder accommodation spaces 25, and terminal accommodation chambers 21 adjacent to the deep side of the waterproof member accommodation spaces 23. An upper surface of the housing 2 is provided with a lock arm 26 that locks a lock projection of a mating connector (not shown) to maintain a fitted state with the mating connector.

The terminal 63 is formed of a conductive metal material, and is a female terminal formed in a cylindrical shape. The terminal 63 is accommodated in the terminal accommodation chamber 21 formed on a front side of the housing 2. The terminal 63 accommodated in the terminal accommodation chamber 21 is locked to a lock lance 28 of a guide portion 27 provided at a front end of the housing 2. After a packing 6 is attached to an outer periphery of a front end of the guide portion 27, a front holder 4 that restricts movement of the lock lance 28 in an unlocking direction is fixed to the front end of the guide portion 27. A connection hole of the terminal 63 communicates with a guide hole of the guide portion 27. A non-illustrated mating terminal (male terminal) can be inserted into the guide hole of the guide portion 27 to which the front holder 4 is fixed at the front end.

A conductor of the electric wire 61 drawn out from a rear end opening of the housing 2 is crimped and electrically connected to a crimp portion on a rear end side of the terminal 63. The waterproof member 65 is attached to the electric wire 61 drawn out from the rear end opening of the housing 2, and is liquid-tightly sealed with respect to the housing 2.

The waterproof member 65 is made of a rubber plug and is in close contact with an inner peripheral surface of the waterproof member accommodation space 23 of the housing 2 when an inner periphery thereof is in close contact with an outer periphery of the electric wire 61 to seal between the housing 2 and the electric wire 61, so that inside of the housing 2 is divided from outside. Such a waterproof member 65 is mounted in the waterproof member accommodation space 23 of the housing 2, and is restricted from being detached by the rear holder 5 assembled to the rear end opening of the housing 2.

Figure 4A:
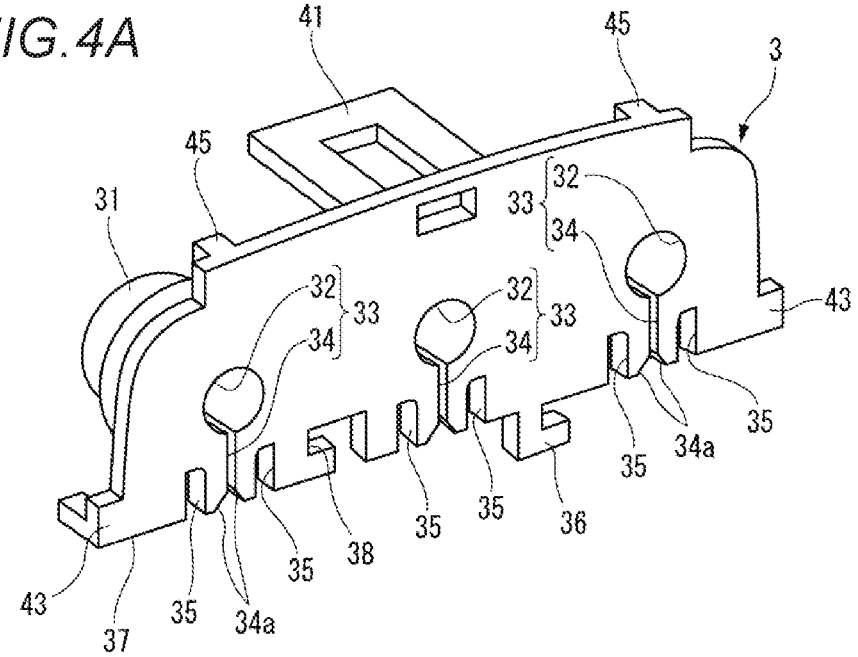
FIG. 4A is a perspective view of an upper combining member shown in FIG. 2 as viewed from a rear side.
Figure 4B:
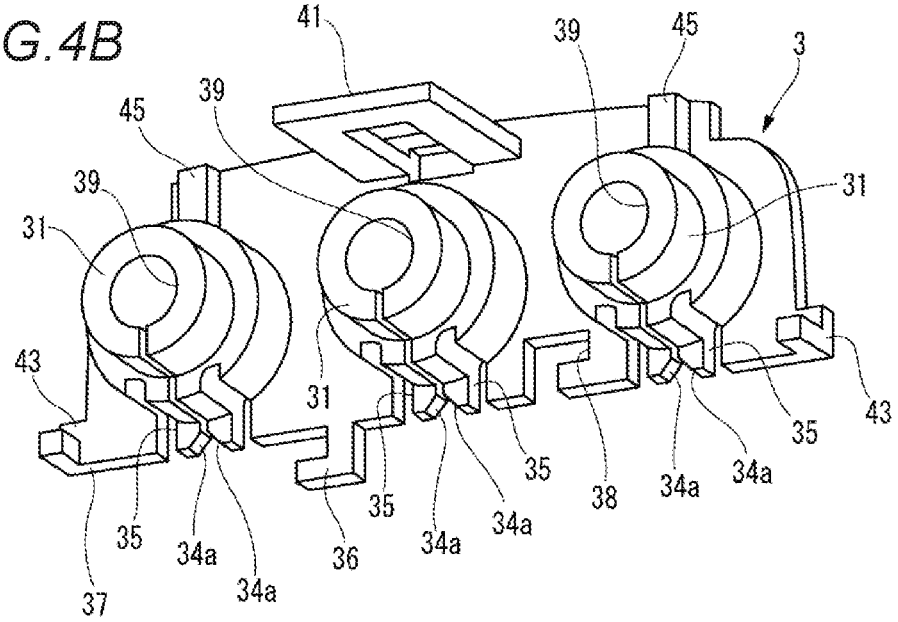
FIG. 4B is a perspective view of the upper combining member shown in FIG. 2 as viewed from a front side.
Figure 5A:
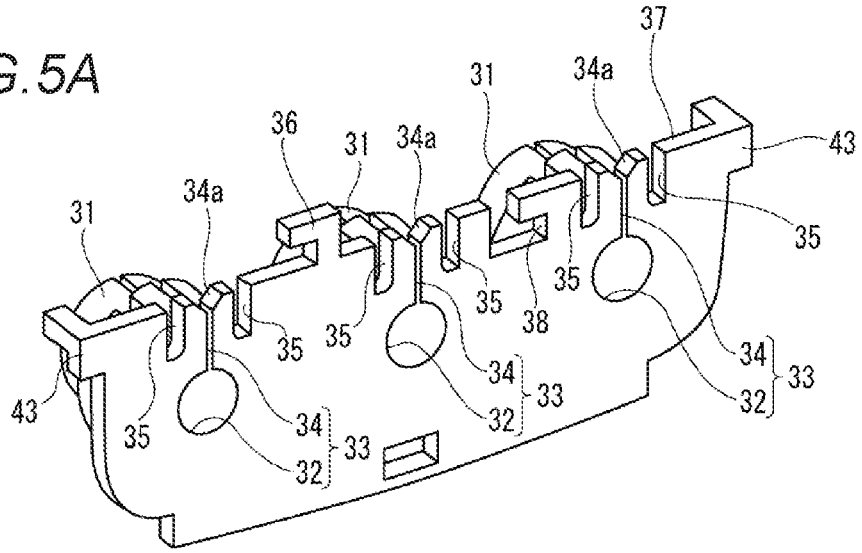
FIG. 5A is a perspective view of a lower combining member shown in FIG. 2 as viewed from the rear side.
Figure 5B:
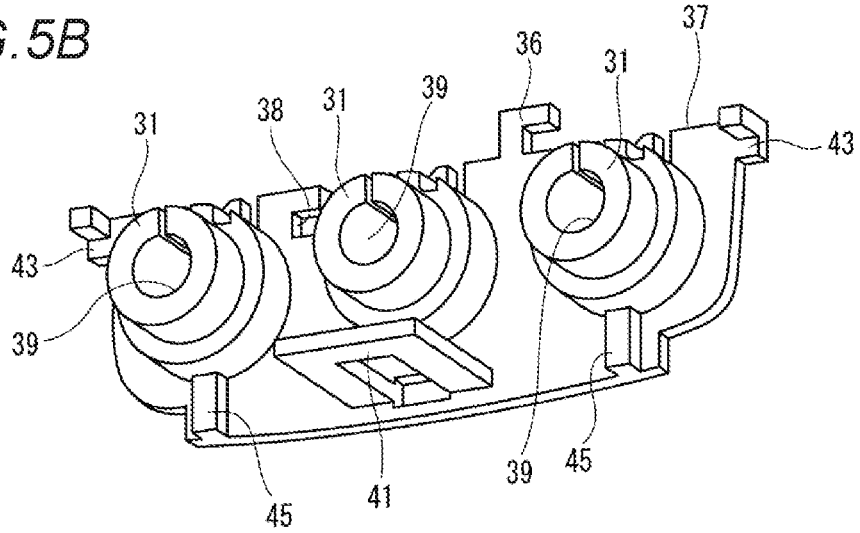
FIG. 5B is a perspective view of the lower combining member shown in FIG. 2 as viewed from the front side.

FIG. 4A is a perspective view of an upper combining member 3 shown in FIG. 2 as viewed from a rear side, and FIG. 4B is a perspective view of the upper combining member 3 shown in FIG. 2 as viewed from a front side. FIG. 5A is a perspective view of a lower combining member 3 shown in FIG. 2 as viewed from the rear side, and FIG. 5B is a perspective view of the lower combining member 3 shown in FIG. 2 as viewed from the front side.

As shown in FIG. 1, the rear holder 5 is made of an electrically insulating synthetic resin, and is configured by combining two combining members 3 formed in a substantially rectangular plate shape to hold the electric wires 61, mating surfaces 37 being mated with each other.

As shown in FIGS. 4A and 5A, three slits 33 extending from a mating surface 37 side to an opposite side are formed in the combination member 3. The slit 33 includes a circular deepest portion 32 through which the electric wire 61 is inserted, and a groove-like introduction portion 34 extending to the deepest portion 32.

The deepest portion 32 of the slit 33 is formed as a through hole having an opening width (an inner diameter) equal to or slightly smaller than an electric wire diameter in order to hold the inserted electric wire 61. An opening width of the introduction portion 34 of the slit 33 that allows the electric wire 61 to enter the deepest portion 32 is smaller than the opening width of the deepest portion 32. As shown in FIGS. 4 and 5, the opening width of the introduction portion 34 is set to be extremely small with respect to the electric wire diameter. A guiding taper 34*a* is formed at an opening end of the introduction portion 34 of the slit 33.

Deflection slits 35 extending from the mating surface 37 are formed on lateral sides of the introduction portion 34 of the slit 33. The deflection slits 35 are formed so as to extend in parallel on both sides of each introduction portion 34. Therefore, the introduction portion 34 of the slit 33 can be elastically deformed and widened at both side edges due to the deflection slits 35 formed laterally.

Further, by combining the two combining members 3 and 3 in which three slits 33 are respectively formed, three electric wire accommodation portions that accommodate the electric wires 61 in pairs are defined. That is, combination is achieved by mating the mating surfaces 37, whereby three electric wire accommodation portions where the electric wires 61 penetrate the deepest portions 32 at upper and lower ends are respectively defined in the rear holder 5 by the slits 33 in the upper combining member 3 and the slits 33 in the facing lower combining member 3.

As shown in FIGS. 4B and 5B, cylindrical press portions 31 each having an insertion hole 39 into which the electric wire 61 is inserted project on a front surface side of the combining member 3. The insertion hole 39 communicates with the deepest portion 32 of the slit 33.

Lock pieces 41 are respectively formed at upper and lower edges (edges opposite to the mating surfaces 37 of the combining members 3) of the rear holder 5 into which the two combining members 3 are combined. The lock piece 41 is formed in a frame shape opened rearward and projects forward in a cantilever manner, and a projecting end side of the lock piece 41 is elastically deflectable in an upper-lower direction. The lock pieces 41 are locked to the lock projections 29 projecting from upper and lower surfaces of a rear end of the housing 2.

The lock projection 29 deflects the lock piece 41 when the press portion 31 of the combining member 3 is inserted into the rear holder accommodation space 25 of the housing 2, and locks the lock piece 41 when the rear holder 5 is assembled to the housing 2.

By locking of the lock piece 41 and the lock projection 29, an assembled state of the rear holder 5 to the housing 2 is maintained, and the rear holder 5 is not detached from the housing 2, so that the rear holder 5 can reliably prevent detachment of the waterproof member 65 from the housing 2.

Mating portions 43 are respectively formed so as to project from both ends of the mating surface 37 of each combining member 3 on a right side edge and a left side edge of the rear holder 5. Pairs of mating portions 43 of the mated mating surfaces 37 are respectively engaged with recesses 22 formed at both side edges of the rear end of the housing 2 so as to be sandwiched in a housing upper-lower direction (the upper-lower direction in FIG. 1). Therefore, the two combining members 3 and 3 are reliably maintained in a combined state.

As shown in FIGS. 4 and 5, four engagement projections 45 are formed at the upper and the lower edges of the rear holder 5 to project forward at positions on both sides of the lock pieces 41. The engagement projections 45 are respectively engaged with four recesses 24 formed at both ends of upper and lower edges of the rear end of the housing 2. When the engagement projections 45 are respectively engaged with the recesses 24, the rear holder 5 is positioned with respect to the housing 2 in a housing left-right direction (a left-right direction in FIG. 1).

Figure 10:
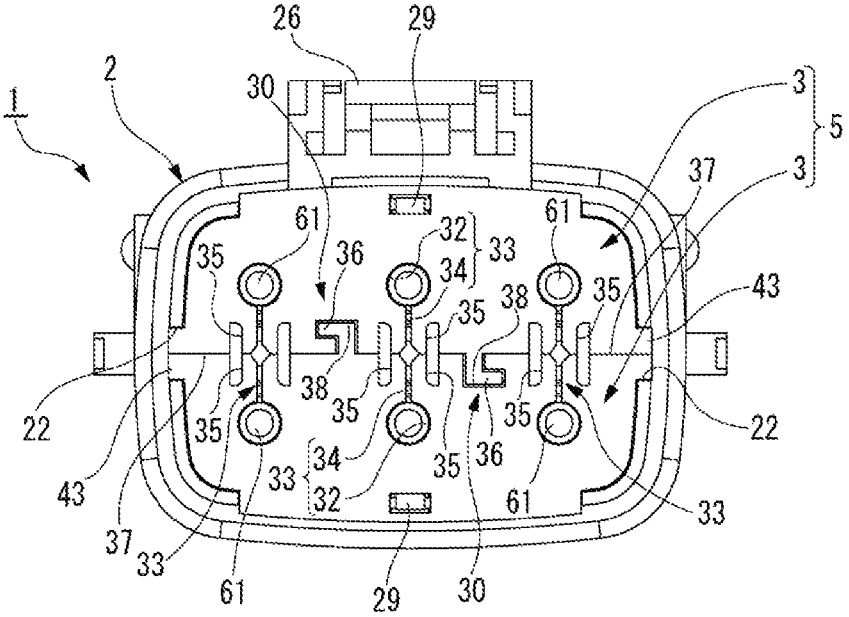
FIG. 10 is a rear view of the waterproof connector for showing a state where the rear holder is attached to the housing.

Further, the combining members 3 are provided with a pair of engagement portions 30 that are engaged in a symmetrical shape when the mating surfaces 37 are mated so as to maintain the combined state (see FIG. 10). The engagement portions 30 are provided between the three slits 33 on the mating surface 37.

The engagement portion 30 includes an L-shaped or inverted L-shaped engagement projection 36 and an L-shaped or inverted L-shaped engagement recess 38 into which the engagement projection 36 is inserted. Further, the engagement portions 30 bring the combining members 3 and 3 close to each other such that the mating surfaces 37 are mated with each other in a length direction of the electric wires 61, and the engagement projections 36 are inserted into and engaged with the engagement recesses 38.

When the two combining members 3 and 3 are combined together with the mating surfaces 37 mated, the engagement projections 36 respectively formed on the combining members 3 are engaged with the engagement recesses 38, so that the combining members 3 and 3 can be prevented from moving in a direction away from the mating surfaces 37 or moving along the mating surfaces 37, and the combined state of the combining members 3 and 3 can be maintained.

Next, a procedure of attaching the rear holder 5 according to the waterproof connector 1 of the present embodiment to the rear end of the housing 2 will be described with reference to FIGS. 6 to 10.

Figure 6:
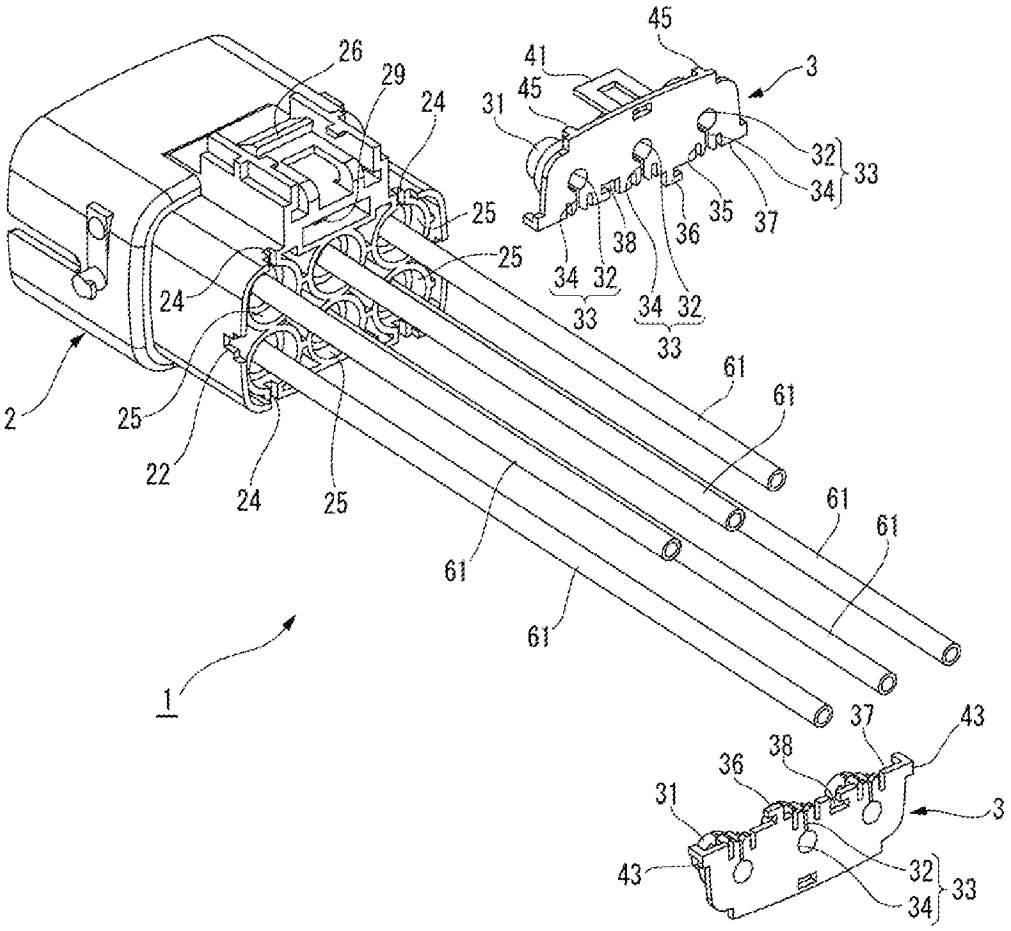
FIG. 6 is a perspective view of the waterproof connector for illustrating a procedure of attaching a rear holder to a housing.
Figure 7A:
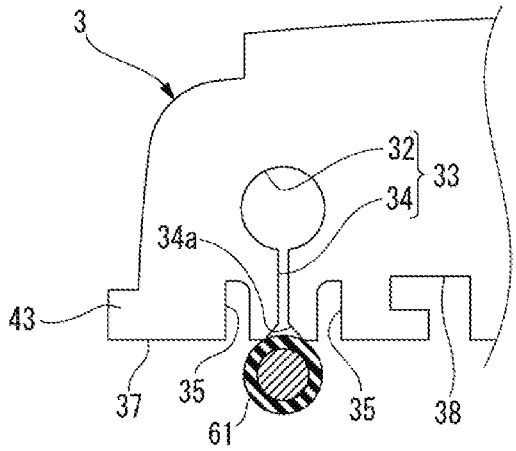
FIGS. 7A to 7C are enlarged views of a main part for illustrating an operation when an electric wire enters a slit in an electric wire accommodation portion of the rear holder.
Figure 7B:
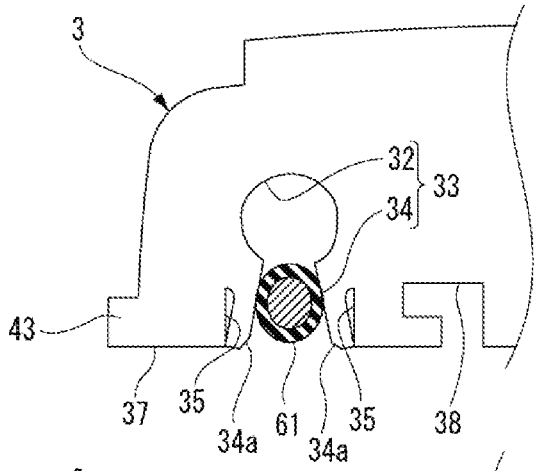
Figure 7C:
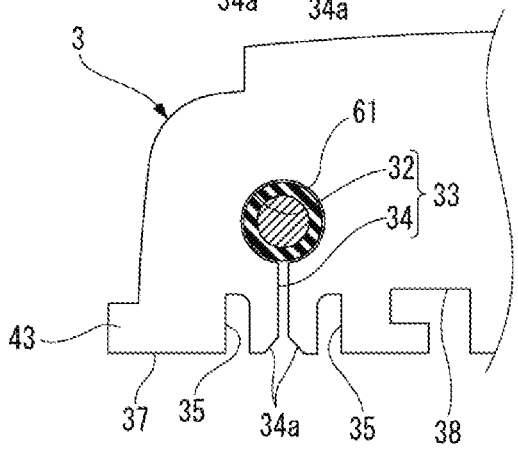
Figure 8:
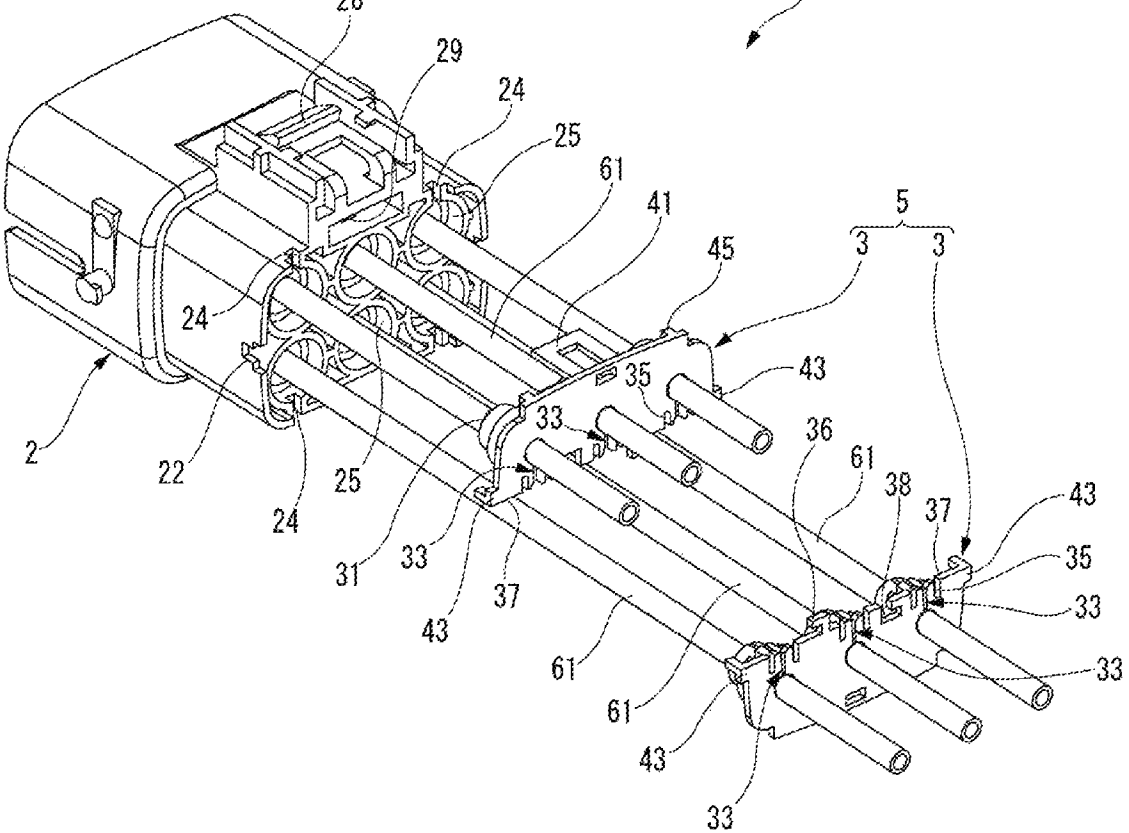
FIG. 8 is a perspective view of the waterproof connector for illustrating the procedure of attaching the rear holder to the housing.
Figure 9:
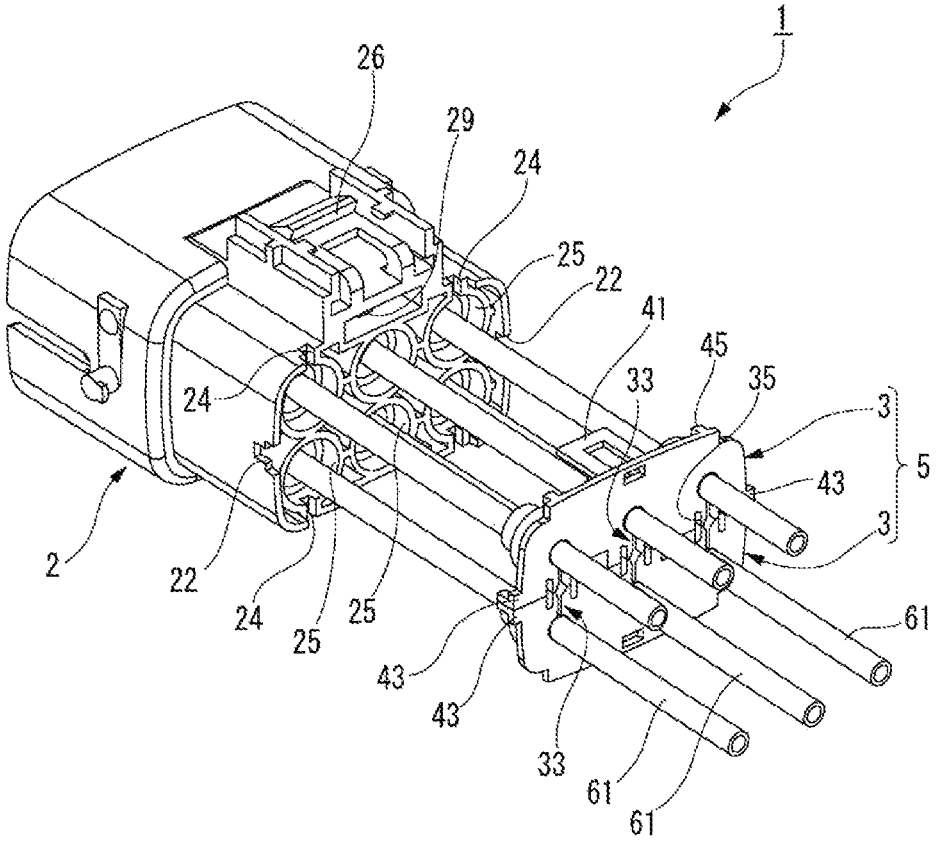
FIG. 9 is a perspective view of the waterproof connector for illustrating the procedure of attaching the rear holder to the housing.

FIG. 6 is a perspective view of the waterproof connector 1 for illustrating the procedure of attaching the rear holder 5 to the housing 2, and FIGS. 7A to 7C are enlarged views of a main part for illustrating an operation when the electric wire 61 enters the slit 33 in the electric wire accommodation portion of the rear holder 5. FIGS. 8 and 9 are perspective views of the waterproof connector 1 for illustrating the procedure of attaching the rear holder 5 to the housing 2. FIG. 10 is a rear view of the waterproof connector 1 for showing a state where the rear holder 5 is attached to the housing 2.

First, as shown in FIG. 6, the terminals 63 crimped to the ends of the electric wires 61 are respectively accommodated in the terminal accommodation chambers 21 of the housing 2. The upper and lower rows of electric wires 61 are drawn out from the rear end opening of the housing 2, each row having three electric wires arranged. Further, the three electric wires 61 in the upper row are respectively inserted into the slits 33 of the upper combining member 3, and the three electric wires 61 in the lower row are respectively inserted into the slits 33 of the lower combining member 3.

As shown in FIG. 7A, the electric wire 61 enters the slit 33 of the electric wire accommodation portion formed in the combining member 3 from the mating surface 37 side. Since the guiding taper 34*a* is formed at the opening end of the introduction portion 34, the electric wire 61 can easily enter the slit 33 while pushing and spreading the introduction portion 34.

As shown in FIG. 7B, the introduction portion 34 of the slit 33 can be elastically deformed and widened due to the deflection slits 35 formed laterally. Therefore, the electric wire 61 can be moved to the deepest portion 32 when the introduction portion 34 is pushed and spread.

As shown in FIG. 7C, when the electric wire 61 moves to the deepest portion 32 of the slit 33, the introduction portion 34 of the slit 33 returns to an original opening width that is extremely small with respect to the electric wire diameter.

As shown in FIG. 8, the combining members 3 are in a state where the electric wires 61 penetrate the slits 33 serving as the electric wire accommodation portions.

Next, as shown in FIG. 9, the combining members 3 and 3 are brought close to each other such that the mating surfaces 37 are mated with each other in the length direction of the electric wires 61, and the engagement projections 36 are inserted into the engagement recesses 38 to engage the engagement portions 30. Therefore, the rear holder 5 is constituted by the two combined combining members 3 and 3.

Thereafter, the rear holder 5 is moved toward the rear end opening of the housing 2 along the length direction of the electric wires 61, and the press portions 31 are inserted into the rear holder accommodation spaces 25 of the housing 2. As shown in FIG. 3, the press portions 31 of the rear holder 5 inserted into the rear holder accommodation spaces 25 restrict detachment of the waterproof members 65 accommodated in the waterproof member accommodation spaces 23.

In the rear holder 5 attached to the rear end opening of the housing 2, the engagement projections 45 are engaged with the recesses 24 of the housing 2, and are positioned with respect to the housing 2 in the housing left-right direction. The pairs of mating portions 43 at left and right ends of the rear holder 5 are engaged with the recesses 22 of the housing 2 to be sandwiched in the housing upper-lower direction, whereby the combined state of the left and right ends of the two combining members 3 and 3 are reliably maintained.

The pair of upper and lower lock pieces 41 is locked to the lock projections 29 of the housing 2, whereby the assembled state of the rear holder 5 to the housing 2 is maintained.

As shown in FIG. 10, in the rear holder 5 attached to the rear end opening of the housing 2, at least openings of the rear holder 5 facing the waterproof members 65 accommodated in the waterproof member accommodation spaces 23 are only the introduction portions 34 of the slits 33 having the opening width smaller than the electric wire diameter.

That is, since the opening (the rhombic opening defined by the opening end of the slit 33 of the upper combining member 3 and the opening end of the slit 33 of the lower combining member 3) defined by the deflection slits 35 formed in the combining members 3 and the guiding tapers 34*a* formed at the opening ends of the introduction portions 34, is not arranged at a position facing the waterproof members 65, an external force such as high-pressure washing water does not reach the waterproof members 65 through the opening.

Figure 11A:
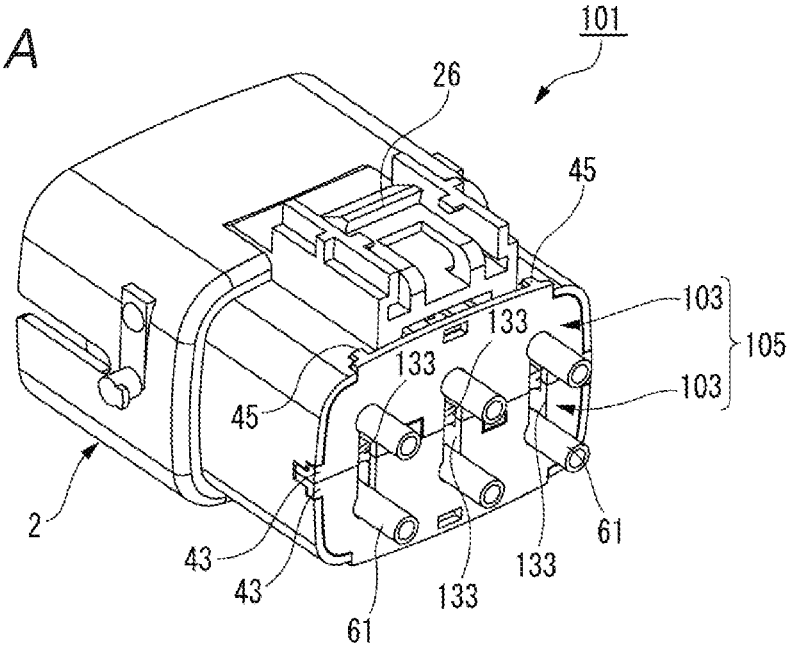
FIGS. 11A and 11B are a perspective view and a rear view of a waterproof connector according to a reference example.
Figure 11B:
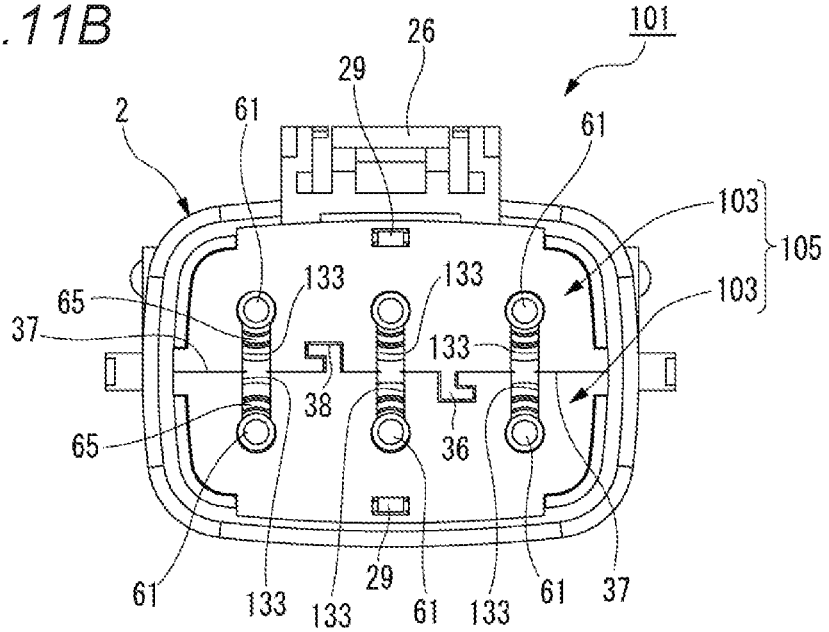

FIGS. 11A and 11B are a perspective view and a rear view of a waterproof connector 101 according to a reference example. Since the waterproof connector 101 has the same configuration as that of the waterproof connector 1 except that a rear holder 105 is used instead of the rear holder 5, the same components are denoted by the same reference numerals and detailed description thereof will be omitted.

As shown in FIGS. 11A and 11B, the rear holder 105 is configured by combining two combining members 103 formed in a substantially rectangular plate shape to hold the electric wires 61, the mating surfaces 37 being mated with each other.

In the combining members 103, substantially oval recesses 133 are formed to have an opening width equal to the electric wire diameter and to be greatly recessed from the mating surfaces 37.

Therefore, as shown in FIG. 11, in the rear holder 105 configured by combining the two combining members 103, openings having an opening width equal to the electric wire diameter are formed between the electric wire accommodation portions defined by pairs of recesses 133, and the electric wires 61. Therefore, an external force such as high-pressure washing water may reach the waterproof members 65 through the openings to reduce the waterproofness of the waterproof members 65.

In contrast, as shown in FIG. 10, in the rear holder 5 of the waterproof connector 1 according to the present embodiment, at least the openings of the rear holder 5 facing the waterproof members 65 are only the introduction portions 34 of the slits 33 having the opening width smaller than the electric wire diameter, and no opening having an opening width equal to the electric wire diameter is generated. Therefore, the rear holder 5 can reduce the influence of the external force such as high-pressure washing water on the waterproof members 65.

Next, an operation of the waterproof connector 1 according to the present embodiment will be described.

According to the waterproof connector 1 of the present embodiment, the deepest portion 32 of the slit 33 in the electric wire accommodation portion formed in each combining members 3 is formed to have the opening width equal to or slightly smaller than the electric wire diameter in order to hold the inserted electric wire 61. The introduction portion 34 of the slit 33 is formed to have the opening width smaller than the opening width of the deepest portion 32. Here, since the introduction portion 34 of the slit 33 can be elastically deformed and widened due to the deflection slits 35 formed laterally, the opening width can be set to be smaller than the electric wire diameter.

Therefore, the electric wire 61 enters the slit 33 of the electric wire accommodation portion formed in each combining member 3 from the mating surface 37 side, and is moved to the deepest portion 32 while pushing and spreading the introduction portion 34, whereby the electric wire 61 comes into a state of penetrating the electric wire accommodation portion in each combining member 3. Further, the rear holder 5, in which the combining members 3 and 3 are combined by mating the mating surfaces 37, is assembled to the housing 2, so that detachment of the waterproof members 65 can be prevented. At this time, at least the openings of the rear holder 5 facing the waterproof members 65 are only the slits 33 having the opening width smaller than the electric wire diameter, and no opening having an opening width equal to the electric wire diameter is generated. Therefore, the rear holder 5 can reduce the influence of the external force such as high-pressure washing water on the waterproof members 65.

Accordingly, in the waterproof connector 1 of the present embodiment, even when a plurality of electric wires 61 passing through the rear holder 5 are arranged in a plurality of rows, the rear holder 5 can be constituted by the two combining members 3 and 3 without reducing the waterproofness, so that the workability of assembling the rear holder 5 can be improved.

According to the waterproof connector 1 of the present embodiment, when the electric wire 61 is inserted into the introduction portion 34 of the slit 33 from the mating surface 37 side, the electric wire 61 can easily enter the slit 33 while pushing and spreading the introduction portion 34 since the guiding taper 34*a* is formed at the opening end.

In addition, according to the waterproof connector 1 of the present embodiment, the two combining members 3 and 3 are provided with the engagement portions 30 that are engaged in a symmetrical shape when the mating surfaces 37 are mated so as to maintain the combined state. Therefore, even in a case where the two combining members 3 have the same shape, the engagement portions 30 can maintain the combined state. Therefore, in the waterproof connector 1 having the present configuration, the rear holder 5 can be formed of one kind of the combining members 3, so that the number of parts and the manufacturing cost can be reduced.

According to the waterproof connector 1 of the present embodiment, in the two combining members 3 and 3 constituting the rear holder 5, the mating portions 43 at both ends of the mating surfaces 37 are engaged with the recesses 22 of the housing 2 to maintain the combined state. Therefore, a gap is prevented from being generated between the mating surfaces 37 of the two combining members 3 and 3, and the two combining members 3 and 3 can be firmly coupled.

Therefore, according to the waterproof connector 1 of the present invention, in the waterproof connector in which the plurality of terminal accommodation chambers 21 of the housing 2 are arranged in the plurality of rows, the workability of assembling the rear holder 5 can be improved without reducing the waterproofness.

The present invention is not limited to the above-described embodiment, and may be appropriately modified, improved or the like. In addition, the material, shape, size, number, arrangement position and the like of each component in the above-described embodiment are any and not limited as long as the present invention can be achieved.

The features of the embodiment of the waterproof connector according to the present invention described above will be briefly summarized in the following [1] to [4].

[1] A waterproof connector (1) comprising:

a housing (2) in which a plurality of terminal accommodation chambers (21) that accommodate terminals (63) connected to electric wires (61) are arranged in a plurality of rows;

at least one waterproof member of a plurality of waterproof members (65) provided between the housing (2) and one of the electric wires so as to divide the inside of the housing from the outside of the housing; and a rear holder (5) assembled to the housing (2) so as to prevent detachment of the at least one waterproof member from the housing, wherein the rear holder includes two combining members (3 and 3) with mating surfaces (37) that are combined with each other so as to hold the electric wires, and that form an electric wire accommodation portion accommodating the electric wires when the mating surfaces are mated, wherein the two combining members have slits (33) that allow the electric wires to enter from mating surface sides and hold the electric wires, wherein opening widths of introduction portions (34) of the slits extending to deepest portions (32) of the slits are formed to be smaller than opening widths of the deepest portions, and wherein the two combining members have deflection slits (35) extending from the mating surfaces on lateral sides of the introduction portions.

[2] The waterproof connector (1) according to [1], wherein guiding tapers (34*a*) are formed at opening ends of the introduction portions (34).

[3] The waterproof connector (1) according to [1] or [2], wherein the two combining members (3 and 3) are provided with engagement portions (30) that are engaged in a symmetrical shape when the mating surfaces (37) are mated so as to maintain a combined state.

[4] The waterproof connector (1) according to any one of [1] to [3], wherein the two combining members (3 and 3) are provided with mating portions (43) at both ends of the mating surfaces (37), the mating portions (43) engaged with recesses (22) of the housing to maintain the combined state.

What is claimed is:

1. A waterproof connector comprising:

a housing in which a plurality of terminal accommodation chambers that accommodate terminals connected to electric wires are arranged in a plurality of rows;

at least one waterproof member of a plurality of waterproof members provided between the housing and one of the electric wires so as to divide the inside of the housing from the outside of the housing; and a rear holder assembled to the housing so as to prevent detachment of the at least one ef waterproof member from the housing, wherein the rear holder includes two combining members with mating surfaces that are combined with each other so as to hold the electric wires, and that form an electric wire accommodation portion accommodating the electric wires when the mating surfaces are mated, wherein each of the two combining members has slits that allow the electric wires to enter from mating surface sides and hold the electric wires, wherein opening widths of introduction portions of the slits extending to deepest portions of the slits are formed to be smaller than opening widths of the deepest portions, and wherein each of the two combining members has deflection slits extending, in parallel to the introduction portions extending to the deepest portions, on lateral sides of the introduction portions.

2. The waterproof connector according to claim 1, wherein guiding tapers are formed at opening ends of the introduction portions, the guiding tapers tapering from the opening ends toward the deepest portions.

3. The waterproof connector according to claim 1, wherein the two combining members are provided with engagement portions that are engaged in a symmetrical shape when the mating surfaces are mated so as to maintain a combined state.

4. The waterproof connector according to claim 1, wherein the two combining members are provided with mating portions at both ends of the mating surfaces, the mating portions engaged with recesses of the housing to maintain a combined state.

5. The waterproof connector according to claim 1, wherein opening widths of the deflection slits are formed to be larger than the opening widths of the introduction portions of the slits and smaller than the opening widths of the deepest portions.

* * * * *